US007742361B2

(12) United States Patent
Behling et al.

(10) Patent No.: US 7,742,361 B2
(45) Date of Patent: Jun. 22, 2010

(54) METHOD FOR CHANGING A TIME ZONE, AND TIMEPIECE THEREFOR

(75) Inventors: Christoph Behling, London (GB); Gregoire Renoux, Neuchatel (CH)

(73) Assignee: LVMH Swiss Manufactures SA, La Chaux-De Fonds (CH)

( * ) Notice: Subject to any disclaimer, the term of this patent is extended or adjusted under 35 U.S.C. 154(b) by 0 days.

(21) Appl. No.: 12/262,421

(22) Filed: Oct. 31, 2008

(65) Prior Publication Data

US 2009/0052284 A1 Feb. 26, 2009

Related U.S. Application Data

(63) Continuation of application No. PCT/EP2006/062682, filed on May 29, 2006.

(51) Int. Cl.
*G04B 19/04* (2006.01)
*G04B 19/22* (2006.01)

(52) U.S. Cl. ..... 368/21; 368/80

(58) Field of Classification Search ..... 368/21, 368/27, 80

See application file for complete search history.

(56) References Cited

U.S. PATENT DOCUMENTS 4,274,151 A 6/1981 Kamiwaki
4,470,707 A * 9/1984 Chambon et al. ..... 368/74
5,195,062 A * 3/1993 Masahiro et al. ..... 368/21
5,210,721 A * 5/1993 Kikuchi ..... 368/21
5,237,544 A * 8/1993 Sase et al. ..... 368/21
5,497,358 A * 3/1996 Koch ..... 368/21
6,751,164 B1 * 6/2004 Sekiguchi ..... 368/80
2005/0128875 A1 * 6/2005 Bron ..... 368/21
2005/0180265 A1 * 8/2005 Van Selst ..... 368/21

FOREIGN PATENT DOCUMENTS

DE 4015685 11/1991
EP 0644469 3/1995

OTHER PUBLICATIONS

International Search Report dated Dec. 14, 2006.

* cited by examiner

*Primary Examiner*—Vit W Miska
(74) *Attorney, Agent, or Firm*—Pearne & Gordon LLP

(57) ABSTRACT

Method for switching the time zone indicated by a timepiece (1) in order to switch from an initial time zone to a modified time zone, having the following steps:

the user enters a time switch command (268) by means of the crown, the hours' and minutes' hands indicate the time of the modified time zone (274), whilst the seconds' hand indicates a city corresponding to the selected time zone, the timepiece automatically returns (280) to the initial time zone and indicates the time of the initial time zone (202), or the time of the modified time zone is retained by means of a command from the user.

16 Claims, 3 Drawing Sheets

METHOD FOR CHANGING A TIME ZONE, AND TIMEPIECE THEREFOR

This utility patent application is a continuation of international patent application PCT/EP2006/062682, filed May 29, 2006, the content of which is incorporated by reference.

TECHNICAL FIELD

The present invention concerns the field of watches allowing several time zones to be displayed and a method for switching the time zone.

STATE OF THE ART

Watches for displaying several time zones are known per se. Certain known watches have several indicators, for example several hand sets, to display simultaneously the time of several time zones. Other watches have means for switching more rapidly from one time zone to another on the same display without having to reset the time. The number of time zones used in different countries or regions of the world is however too great to allow a simultaneous display of all the time zones on a wristwatch. It is thus necessary to allow the user to switch comfortably the time zone indicated by the display or by one of the displays of the watch.

Different solutions have thus been conceived to introduce easily time zone switch commands, that allow for example the displayed time to be moved forward or background by full steps and without having to set the time accurately in the new time zone. The time zone switch however generally requires the user's full attention. Many owners of multiple time zone watches use this function relatively rarely, for example during important trips, and shy away from performing these manipulations they are not much used to, out of fear of losing the watch's time and having to set it again.

Furthermore, it is sometimes useful to look up the time of another time or time zone without setting the watch. Typically, before telephoning in a country far away, one often wishes to make certain of the time of one's interlocutor. Adding or subtracting a time shift—inasmuch as it is known—is however not convenient. There are indeed electronic diaries that allow the time of different places from predefined lists to be displayed, but these diaries are often complicated to use and less available than a wristwatch.

One aim of the present invention is thus to propose a wristwatch or another timepiece that allows these problems of the prior art to be solved. In particular, one aim of the present invention is to propose an improved method for switching time zone as well as a timepiece that allows the time of another time zone to be looked up quickly.

BRIEF SUMMARY OF THE INVENTION

According to the invention, these aims are achieved notably by means of a timepiece for displaying temporarily another time zone and automatically reverting to the initial time zone, for example after a predetermined duration or following an action of the user. The timepiece has:

hours' and minutes' hands driven by at least a first electric motor, a seconds' hand driven independently of said hours' and minutes' hands by a second electric motor, a microcontroller arranged so as to assign to the seconds' hand the displaying of the seconds in time display mode and to assign to said seconds' hand the indicating of the time zone in time zone switching or looking up mode.

These aims are also achieved by means of a method for switching the time zone indicated by a timepiece in order to switch from an initial time zone to a modified time zone, wherein the user first enters a time zone switch command in order to indicate the time of the modified time zone, the timepiece then returning automatically to the initial time zone to indicate the time of the initial time zone. The selected time zone is indicated by means of the seconds' hand and the time of this zone is immediately displayed by means of the hours' and minutes' hands.

The timepiece having these characteristics thus makes it possible to quickly look up the time of a different time zone, in an instinctive manner and automatically reverting to the initial time zone after a predetermined duration or following a new manipulation of the user, without the time having to be reset.

In a preferred embodiment, the user can retain the time of the modified time zone by entering a command to this effect during a predetermined time span after the mode switch.

BRIEF DESCRIPTION OF THE DRAWINGS

The invention will be better understood by reading an example of embodiment illustrated by the figures, wherein.

EXAMPLES OF EMBODIMENT(S) OF THE INVENTION

In the following description and claims, the expression "timepiece" designates for example a wristwatch, a movement for wristwatch, or another watch component for a watch to be worn on the body. The description refers in particular to a wristwatch.

Figure 1:
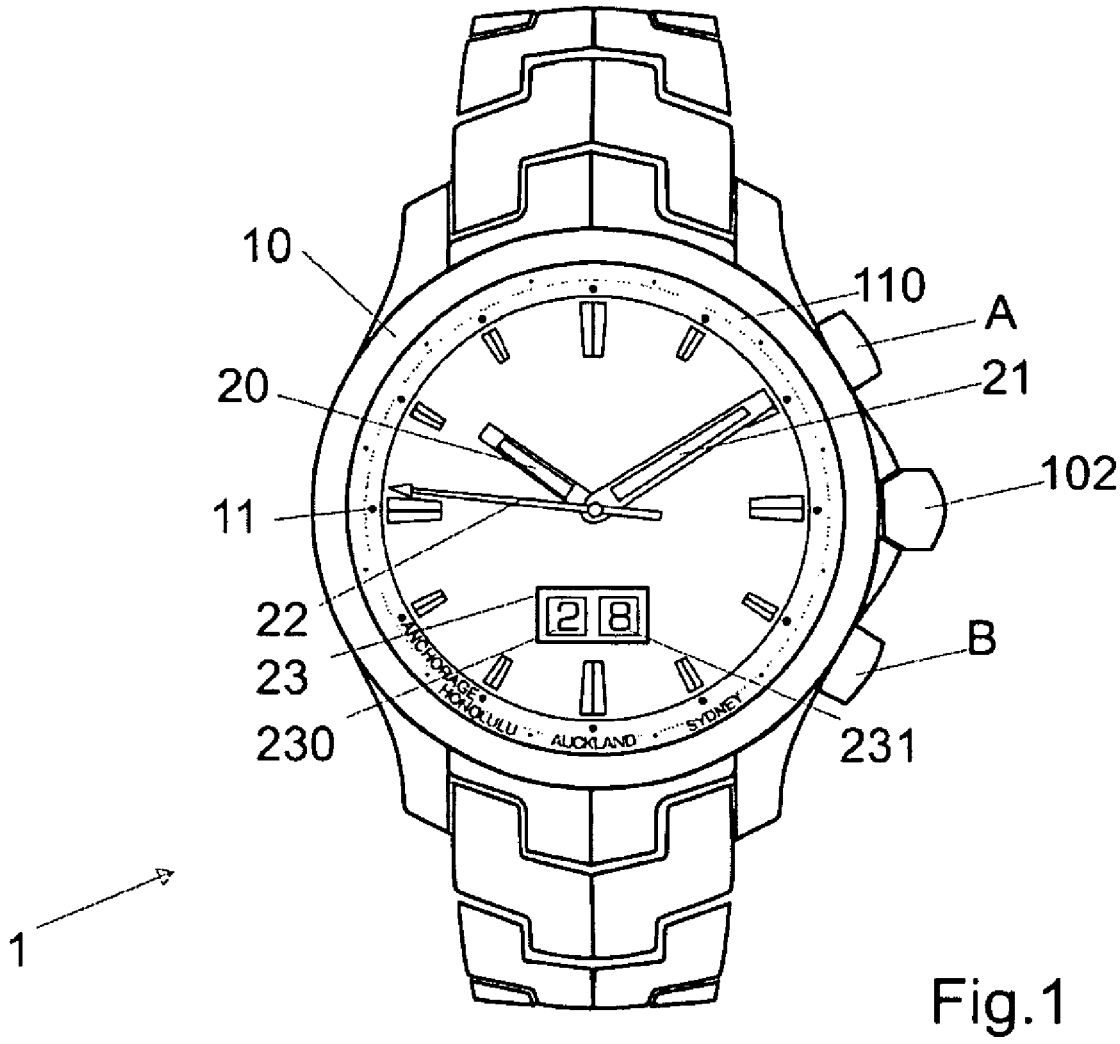
FIG. 1 shows a front view of a watch according to the invention.

The watch 1, illustrated from the front in FIG. 1, has a case 10 accommodating a movement (not represented), preferably an electronic quartz movement, possibly a mechanical movement. The dial is provided with two windows 230, 231 for a grande date display 23. The time is displayed in a conventional manner by means of a hours' hand 20, a minutes' hand 21 and a seconds' hand 22. The three hands are placed at the center and actuated by a stepping motor, or preferably by several independent stepping and preferably bidirectional motors. At least the seconds' hand can be moved independently of the other two hours' and minutes' hands, preferably in a bidirectional manner, in order to be able to be assigned another function during the time zone switch, as will be seen further below. The discs or rings bearing notably the date indications displayed in the windows 230, 231 can be driven through a transmission chain by the stepping motor actuating the hours' hand. In a preferred embodiment, these discs are driven, independently one from the other, by means of additional independent and preferably bidirectional motors. The different motors driving the hands and the other indicators are controlled by a microcontroller (not represented).

Other time indication means, including alphanumeric displays or displays allowing several time zones to be shown simultaneously, can also be used within the frame of the invention.

The watch further has a time set and mode switch crown 102. The crown 102 can occupy three distinct axial positions, for example a stable intermediary position C=0 (resting position), an instable pressed-in position C=−1 to enter into alarm mode or time zone mode, and a pulled-back position C=+1 for setting the date and the time. The crown preferably reverts of itself from the pressed-in position −1 to the intermediary position 0 when it is released. The other position switches require an action from the watch's wearer. Two push-buttons A and B are further provided, which can be pushed by the user to switch from a resting position 0 to a pressed-in position −1. The push-buttons revert on their own to the position 0 when they are released.

The dial, a bezel or a fixed flange 11 bears 24 indications 110 of time zones, each time zone being signaled by a city name except for the Greenwich time zone marked GMT. The city names are placed on one or possibly two concentric arcs or circle. The names of the cities below the 9 o'clock-3 o'clock axis are written with the top of the letters pointing inwards of the watch, whilst the cities above this axis are written with the top of the letters directed outwards. The bottom of the letters is thus always oriented, at more or less 90°, towards 6 o'clock, which makes it easier for the wearer to read them.

Figure 2A:
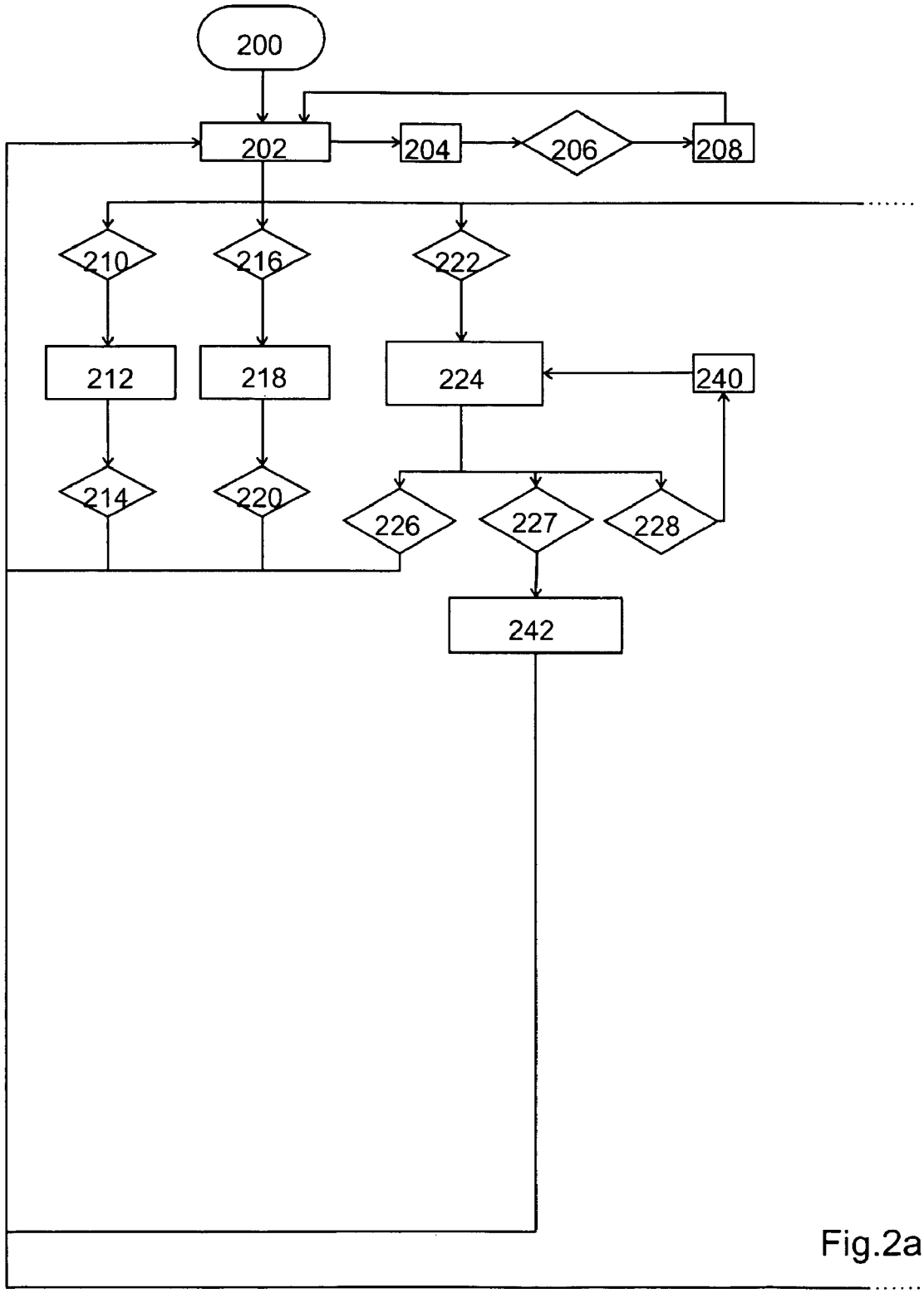
FIG. 2 (spread over two sheets in FIGS. 2*a* and 2*b*) represents an flow diagram of the inventive time zone switch method.
Figure 2B:
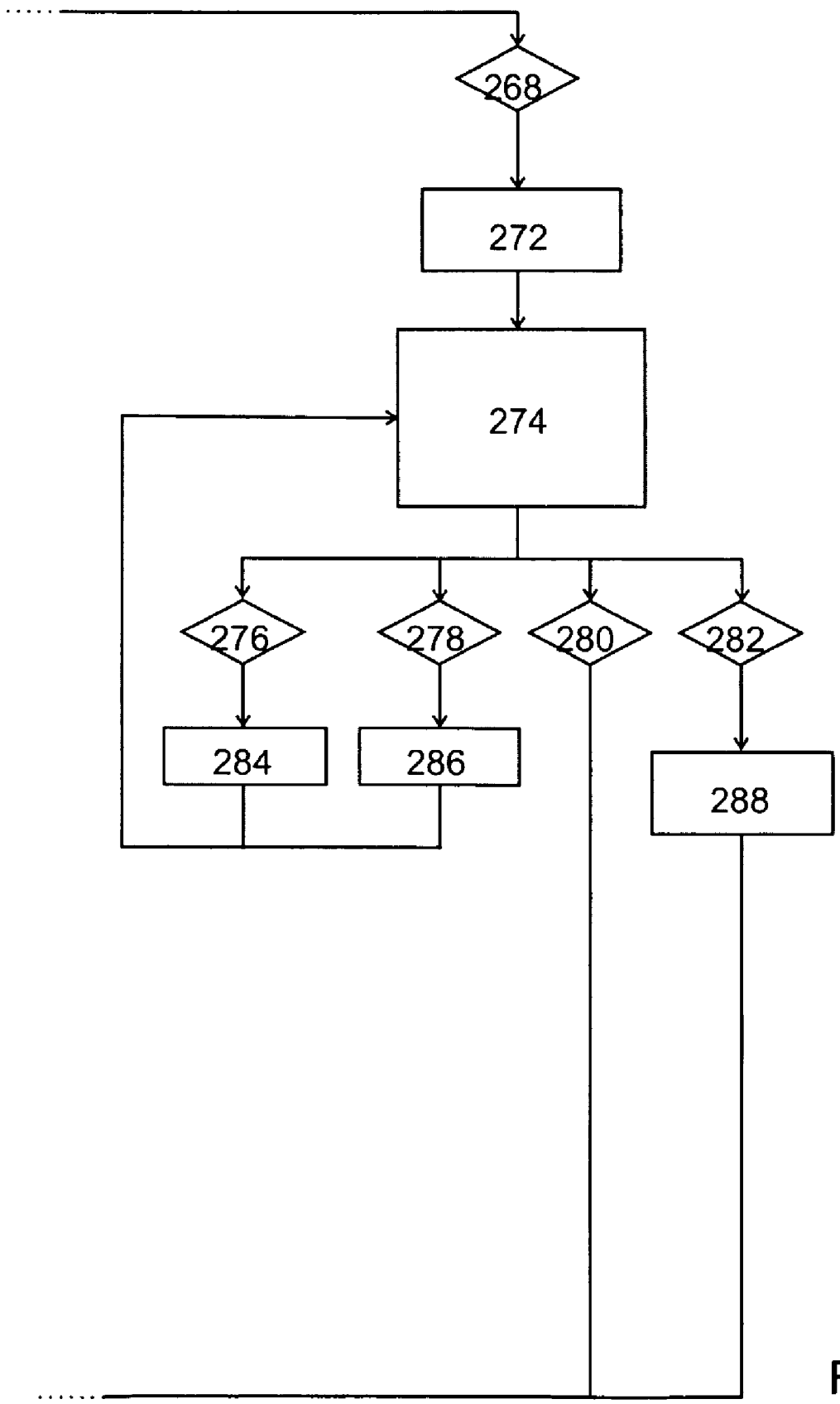

FIG. 2 shows how the watch functions. When the watch is put into operation 200, the microcontroller is reinitialized, the date and time are set at arbitrary values (for example 01.01.2001 at 00:00:00 GMT), the alarm time is set for example at 07:00:00 and the alarm is deactivated. The watch then switches to normal time display mode 202 and the indicators 20-23 start to turn. From this mode, if the alarm ahs been activated, an acoustic alarm signal is emitted at the set time (step 204) that can be stopped by pressing on the crown or on any push-button (step 206) to interrupt the alarm 8208) and return to the time display mode. If the user does not intervene, the alarm is also automatically interrupted after a predetermined duration, for example 60 seconds.

Different actions on the crown or on the push-buttons allow the normal time display mode 202 to be left. By pressing simultaneously on the two push-buttons A and B during more than two seconds (step 210), the movement switches to the hand indexation mode. The hands return to twelve o'clock and the user can enter different commands to move them step-by-step or to center the indicators 230, 231 in the windows (step 212). The watch then returns to the time display mode by pressing on the crown during step 214.

By pulling, during step 216, the crown towards the position C=+1, the watch switches to the time and date set mode 218. Rotations of the crown 102 and/or actions on the push-buttons A and B allow the hands and date indicators to be moved, preferably in both directions, to set the watch's correct time and date. Displacements by full steps, for example displacements by steps of one minute, one hour or one day, can be provided. The watch returns to the time display mode by pushing back the crown to the intermediate position 0.

A prolonged pressing on the crown 102 during step 222 allows the time set for the alarm to be looked up. To this effect, the hours', minutes' and seconds' hands 20 to 22 move during step 224 to indicate the alarm time whilst one of the indicators 230 and/or 231 can move to display an alarm ON or OFF icon, for example in the form of a symbol that is striked through or not. The alarm can be activated resp. deactivated by pressing on one of the push-buttons A or B 8 step 228), which modifies during step 240 the state of the alarm and preferably the corresponding indication displayed in the window 23. The alarm time can be set during step 242 by acting on the push-buttons A and B and/or by rotating the crown; the user starting from the state 224 reaches this alarm setting mode 242 by pulling the crown 102 in the position C=+1 during step 227.

From the state 224 of checking the alarm time, the user returns to the normal time display mode 202 by pressing briefly on the crown or simply by waiting for a predetermined time span, for example five seconds (step 226).

The user can also switch to time zone looking-up and switching mode by pressing briefly on the crown 102 during step 268. Other commands can be provided to this effect, including acting on the push-buttons or rotating the bezel for example. An internal variable [current time zone] of a program executed by the movement's microcontroller then takes during step 272 the value of the time zone currently displayed by the watch. This information is displayed during step 274 by means of the seconds' hand 22 that is moved automatically under the control of the microprocessor, in the rotation direction allowing the shortest journey, to point towards the city representing the current time zone. The other hours' and minutes' hands continue to display the time of the current time zone. Although the seconds are no longer displayed during this step 274, the watch's internal time counter continues to count the time lapsed during this and the following steps, so as to be able to continue displaying the exact time at the second when the seconds' hand reverts to its function and the watch reverts to the normal time display mode.

From the time zone looking-up mode 274, the user can increment the time zone by briefly pressing on the push-button A, or decrement this zone by briefly pressing on the push-button B. The hours' hand 20 is immediately moved during each action on one of these push-buttons whilst the seconds' hand is indexed in the direction corresponding to the selected push-button so as to point towards the city representing the preceding or the following time zone. The value of the current time zone is incremented resp. decremented during the steps 284 resp. 286. It is thus possible to look up very fast the time of any time zone, by pressing on the crown 102 and through a number of presses corresponding to the time shift of the selected time zone on one of the push-buttons A or B. Other means for switching the time zone from the mode 274 can be conceived, for example by turning the crown 102 or a revolving bezel in one direction or the other.

If no action is performed on the elements A, B 102 from the step 274 during a predetermined time span, for example 5 seconds, the watch automatically reverts during step 280 towards the time display mode 202. In a variant embodiment, not represented, the watch returns to displaying the time of the initial time zone following an explicit command from the user. In both cases, the current time zone possibly modified during the steps 284 resp. 286 is not retained and the initial time zone of the watch continues to be displayed. As mentioned, the seconds' hand 22 reverts to its function and shows the current time taking into account the duration of the looking-up stage and of the steps 268 to 280.

In order to retain the time of the current time zone possibly modified during the steps 284 or 286, the user presses on the crown 102 (step 282) from the step 274. The modified time zone is then validated during the step 288, so that the watch's time zone takes the value of the variable [current time zone]. The watch then returns to the normal time display mode 202, the seconds' hand reverts to its normal seconds' display function and the windows 23 return if necessary to the date display mode.

In one embodiment, the time zone looking-up and switching mode can be indicated by a particular icon or symbol displayed in one of the windows 23 during the steps 272 to 288. Preferably, an indication in one of these two windows or in an additional window indicates to the user if the time of the current time zone displayed during step 274 and/or if the current time displayed during the step 202 corresponds to the morning or to the afternoon. This indication can be given by means of alphanumeric indications, for example AM/PM, in one of the windows 230, 231 with the aid of an indication given in an additional window, not represented, or preferably by means of a color, or a typographic design or a symbol displayed in the window in combination with the date indication.

In a variant embodiment, not illustrated, the watch could memorize several time zones, for example the last two time zones selected or temporarily displayed, and make it possible to switch from one to the other by means of a simplified command on one of the control elements.

The method described also applies to the switching between summer time and winter time. In one embodiment, switching from summer time to winder time is effected in the same manner as a change of time zone; the user then considers that he lives at the time of the preceding or following time zone. This variant has the disadvantage of forcing the user to select a remote city, corresponding to another time zone, as time zone displayed during a large part of the year. In another embodiment, the time of each time zone takes into account each day the time zone switches. This embodiment however requires more memory to take into account the dates of the time changes of each time zone; furthermore, different countries in a same time zone often have different rules for switching to summer time. In a third embodiment, the user effects himself the switch to the summer or winter time from his initial time zone or from another looked-up time zone, by means of an appropriate control of the elements A, B and/or 102.

As mentioned, the hours' hands 20, the seconds' hands 22 and the discs or rings displayed in the windows can be moved independently of one another and in bidirectional manner. During time zone switches or if these indicators are assigned another function, the indicators in question then move in the direction of rotation that minimizes the duration of the rotation or the electric consumption for this rotation.

The watch described here above thus uses the seconds' hand 22 to designate the time zone during time zone switches. This characteristic can also be used with watches that would not allow a time zone to be temporarily displayed nor the automatic return to the initial time zone. Conversely, the time zone selected during the time zone switch or when it is temporarily looked up, can be indicated by other indicators in the frame of the invention, for example by an additional hand or disc assigned to this function.

REFERENCE NUMBERS

1 Watch
10 Case
11 Flange
110 Marking of the cities on the flange
A Push-button 1
B Push-button 2
102 Crown
20 Hours' hand
21 Minutes' hand
22 Seconds' hand
23 Grande date display
230 $1^{st}$ window
231 $2^{nd}$ window

The invention claimed is:

1. Method for switching the time zone indicated by a timepiece in order to switch from an initial time zone to a modified time zone and to return to said initial time zone, comprising the steps of:

entering a time zone switch command, in order to select the next or previous time zone, moving the hour hand immediately to the nextor previous time zone, in order to display the time of the modified time zone, moving the second hand in order to display the selected time zone by pointing to a city indication, configuring the timepiece to automatically return to the initial time zone and indicate the time of the initial time zone.

2. The method of claim 1, further comprising the step of configuring said timepiece to automatically return to said initial time zone after a predetermined period.

3. The method of claim 1, further comprising the step of displaying the time at the end of the time zone switch taking into account the time lapsed during the time zone switching process.

4. The method of claim 1, further comprising the steps of:

entering a command to switch to time change mode, moving the seconds' hand to indicate the current time zone, entering one or several commands for switching time zones, the seconds' hand being moved to indicate another time zone following each command, reassigning the function of displaying the seconds to the seconds' hand after a predetermined duration or after a command to retain the modified time is entered.

5. The method of claim 4, further comprising the steps of continuing to move the hours' and minutes' hands during said predetermined period and repositioning the seconds' hand, following said reassignment, in a position taking into account the time lapsed during the time zone selection and during said predetermined period.

6. A timepiece for temporarily displaying another time zone and automatically reverting to an initial time zone, said timepiece comprising:

hours and minutes hands driven by at least a first electric motor, a seconds' hand driven independently of said hours and minutes hands by a second electric motor, a microcontroller allowing the user to introduce a time zone switch command, so as to move the hour hand in order to display the next or previous time zone, the microcontroller being arranged so as to assign said seconds' hand to the displaying of the seconds in time display mode and to assign said seconds' hand to the indicating of the time zone in time zone switching or looking-up mode.

7. The timepiece of claim 6, having a counter to effect said automatic return to the initial time zone after a predetermined duration.

8. The timepiece of claim 7, having means for effecting said return following an action from the user and before the end of said duration.

9. The timepiece of claim 8, having means for retaining the display of said other time zone by entering a command from the user during said predetermined duration.

10. The timepiece of claim 6, wherein said second electric motor is a bidirectional step motor capable of turning in a first direction when the time zone is moved in a first direction by means of an incrementing command and of turning in a second direction, opposed to the first direction, when the time zone is moved in a second direction by means of a decrementing command.

11. The timepiece of claim 6, wherein said microcontroller is arranged to move said hours' hand when another time zone is looked up.

12. The timepiece of claim 6, having a window for displaying a morning or evening indication of the time zone currently displayed.

13. The timepiece of claim 12, said morning or evening indication being made by a choice of color and/or of typography of the date displayed in said window, and/or by a graphic element displayed simultaneously with the date in the same window.

14. The timepiece of claim 6, having a crown with at least one fixed axial position and one instable pressed-in position to entering commands, said crown reverting of itself from said instable position to said stable position when it is released.

15. The timepiece of claim 6, for looking up the time of another time zone by means of a single action on an element and a number of presses on another element corresponding to the time shift between the initial time zone and the time zone being looked-up.

16. The timepiece of claim 6, said seconds' hand indicating the current time zone by pointing to a city indication.

* * * * *